US006808003B2

(12) United States Patent
Raghunathan et al.

(10) Patent No.: US 6,808,003 B2
(45) Date of Patent: Oct. 26, 2004

(54) COEXTRUDED PRODUCTS OF ALUMINUM FOAM AND SKIN MATERIAL

(75) Inventors: Narsimhan Raghunathan, Beverwijk (NL); J. Daniel Bryant, Murrysville, PA (US); Andrew J. Hinkle, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/213,617

(22) Filed: Aug. 6, 2002

(65) Prior Publication Data

US 2003/0030181 A1 Feb. 13, 2003

Related U.S. Application Data

(60) Provisional application No. 60/310,675, filed on Aug. 7, 2001.

(51) Int. Cl.[7] ..... B21C 23/24; B22D 19/00

(52) U.S. Cl. ..... 164/98; 164/418; 72/262

(58) Field of Search ..... 164/79, 98, 418, 164/419; 72/262, 268; B22D 27/00, 27/20

(56) References Cited

U.S. PATENT DOCUMENTS

| | | | | | |
|---|---|---|---|---|---|
| 3,941,182 | A | * | 3/1976 | Bjorksten et al. | 164/461 |
| 4,217,852 | A | | 8/1980 | Nagai et al. | 118/405 |
| 4,314,835 | A | * | 2/1982 | Pelton | 65/22 |
| 5,000,025 | A | | 3/1991 | Beekel | 72/250 |
| 5,151,246 | A | * | 9/1992 | Baumeister et al. | 419/2 |
| 5,632,319 | A | * | 5/1997 | Yang et al. | 164/79 |

* cited by examiner

*Primary Examiner*—Kiley Stoner
*Assistant Examiner*—Len Tran
(74) *Attorney, Agent, or Firm*—Norman F. Hainer, Jr.

(57) ABSTRACT

A method of operating a twin wheel conform metal extrusion device or a cladding extrusion device for producing a composite of an extruded metal shell bonded to a metal foam core. A metal feedstock is extruded through an extrusion die defining a cavity housing a hollow extrusion mandrel to produce a metal shell. Liquid foam of a second metal is simultaneously delivered through the hollow mandrel bore such that the foam exiting the axial bore is metallurgically bonded to the metal extruded through the cavity.

14 Claims, 2 Drawing Sheets

COEXTRUDED PRODUCTS OF ALUMINUM FOAM AND SKIN MATERIAL

RELATED APPLICATION

Figure 1:
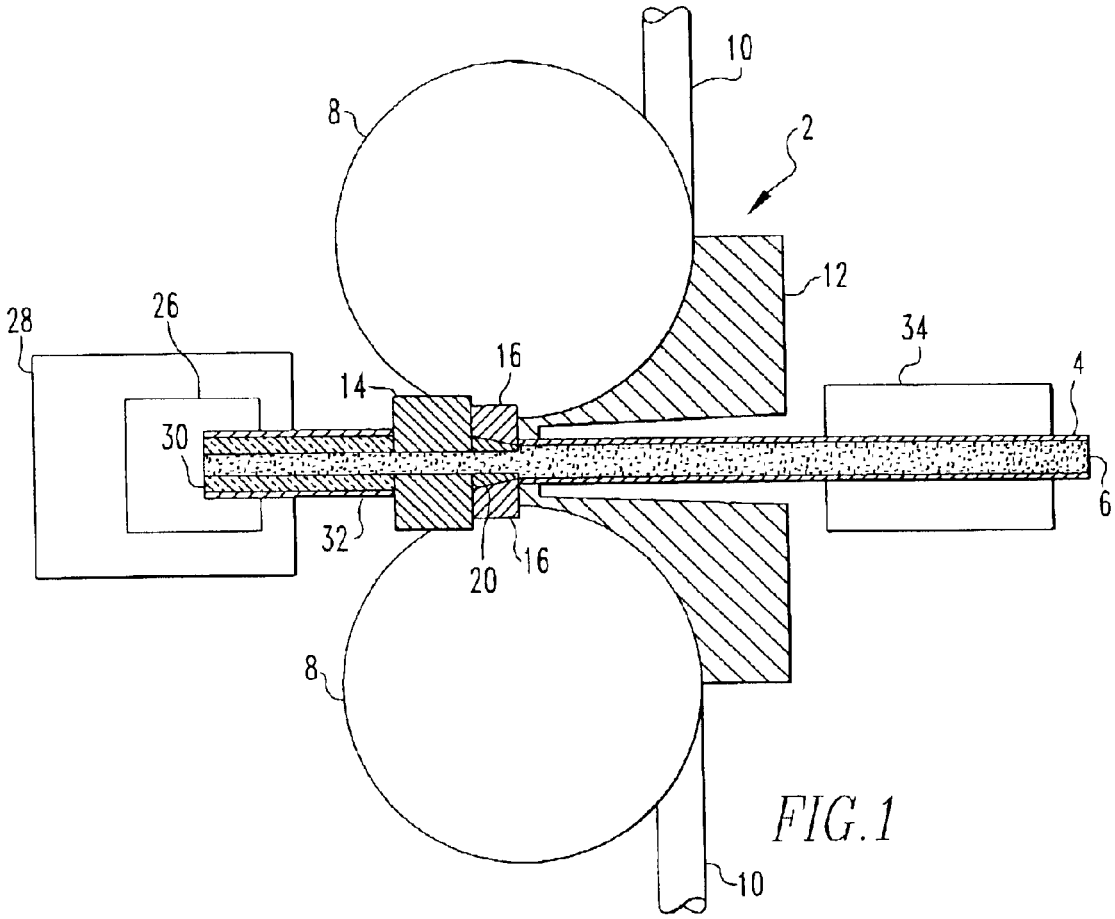

This application claims the benefit of U.S. Provisional Patent Application Ser. No. 60/310,675 filed Aug. 7, 2001 entitled "Coextruded Products of Aluminum Foam and Skin Material".

BACKGROUND OF THE INVENTION

1. Field of the Invention

The present invention relates to a co-extruded product for structural applications having a metallic foam core with a skin structure, wherein the skin structure may also be metallic and methods of making the same.

2. Prior Art

Aluminum and aluminum alloy extrusions are used for various applications in several industries such as in building, construction, transportation, and infrastructure. Typical examples of such applications are window frames, door frames, automotive frames, bus frames, aircraft frames, bridge frames, frames for ships and boats, light poles, and the like. Certain physical and mechanical characteristics of aluminum alloy extrusions preclude them from being considered as suitable materials in certain applications.

For example, in building and construction industries, aluminum alloy extrusions (also termed profiles) are often restricted to certain sections of the buildings such as top stories due to their low load bearing capacities compared to other materials such as steel. One way to improve load bearing capacity is to increase the wall thickness of the profiles, but that increases the cost due to the greater quantity of aluminum used in the profiles.

The thermal characteristics of aluminum alloy products affects their use in extrusions. In particular the thermal conductivity and thermal expansion of aluminum alloy profiles are high compared to other competing materials such as steel, wood and plastic. While in many instances this may be desirable, in a large majority of applications this is undesirable and thus some complex designs are required for the aluminum alloy products thus leading to higher costs. For example, window frames for buildings are typically made from at least two profiles, an inside profile and an outside profile, with an insulating layer of wood or plastic in between to prevent heat transfer between the outside and inside of a building. Normally, the quantity of profiles for a window frame is greater than two due to a combination of mechanical, thermal and manufacturing requirements. Thus, it is not unusual to have a set of four or five different profiles, which further increases the cost.

In the transportation industry, extruded thin walled aluminum alloy profiles are currently being explored as framing materials for auto, truck, and bus bodies. While various features of aluminum alloy profiles are attractive for these applications (e.g. high stiffness to weight ratio, higher resistance to corrosion, and manufacturability), certain other aspects of aluminum alloy profiles (e.g. sound transmission) make them undesirable. Sound generally travels faster through aluminum than steel and plastic. In addition, vehicle frames made of hollow or semi-hollow aluminum profiles behave like sound pipes and readily transmit noise and vibration to other locations in the vehicle. Sound and vibration may be reduced using thicker profiles, but at a higher cost of materials.

Another specific aspect of aluminum alloy profiles is their energy absorbing characteristics in the event of collision with another vehicle or stationary objects like light poles, side barrier, etc. Due to the limited plastic deforming capacity of alloyed aluminum extrusions compared to steels, more often, the profiles break into pieces during collision.

Many of these problems with aluminum extrusions may be overcome by increasing the thickness of the extrusions, but that increases their cost. Alternatively, extrusions may be filled with metallic foam such as aluminum foam or magnesium foam, which may provide added load bearing capacity, minimize the quantity of profiles for framing, provide sound dampening, reduce vibration and increase energy absorbing capacity without increasing the cost substantially. Extruded infrastructure products such as light poles, highway crash barriers, and the like may also be filled with cellular materials to improve their energy absorbing capacity. Foam filled extruded light poles may exhibit reduced vibrations during heavy winds. Foam filled highway crash barriers may provide improved energy absorbing capacity compared to unfilled extrusions. Polymeric foams are easily fit into a profile but present a fire hazard. Metallic foams reduce the risk from fire, but are more difficult to produce within an extrusion.

Thus, composite materials containing thin metallic skin, filled with cellular materials such as metallic foams are sought after in various fields such as building, construction, transportation, and infrastructures due to the unique combinations of properties such as light weight, high stiffness, high load bearing capacity, high energy absorption capacity, noise damping capacity and fire resistance.

Accordingly, many attempts are being made to produce these types of composite materials. One direction under consideration involves inserting a foam core into a preformed extrusion shell. The foam core may be machined out of a standard foam structure (such as a cylinder that may be manufactured by inexpensive, traditional powder metallurgical or liquid metallurgical methods) and fit into the shell. A disadvantage of this method is that there is no bonding between the shell and the foam core material, and as a result, improvements to the performance are limited. Attempts to create a bond between the foam core and the shell to improve the performance have used traditional adhesive bonding technologies, but at a substantial extra expense.

It is known in the field of casting to manufacture a composite material containing a foam core and a solid shell by casting a shell over a foam core using standard casting operations of sand casting or die casting. While this method offers a way to develop metallic bonding between the shell and the core, the process is restricted to relatively small components. In addition, the surface quality of the shell made by this method is inferior compared to an extruded shell, and the method is restricted to very few alloys that can be cast at temperatures below the temperature at which the core remains solid.

In another related field, simple composite panels are made by first cladding a sheet of aluminum alloy with a sheet of a foam pre-form (not yet a foam), which consists of a low melting alloy in powder form mixed with foaming agents such as hydrides, hydroxides, and carbonates, and then heating the clad product to temperatures above that at which the core material melts and expands into a foam core due to the decomposition of the foaming agents, not unlike the traditional polymer foams. Attempts are being made to extend this method also to make extrusions by co-extruding a billet consisting of a thick shell of material which is filled with the foam pre-form. After extrusion, the co-extruded solid can be heated to temperatures, above which the foam core melts and expands to final shape as indicated above for simple panels. This method is useful only for simple shapes, results in poor surface quality and the dimensions of profiles are difficult to control. Although these processes work, they are considerably expensive due to the need for powder metallurgical pre-forms and also restrictive with respect to the type of alloys that can be used. Thus, there remains a need for a reliable and economical method to make extruded composites having a thin extruded shell containing a foam core.

SUMMARY OF THE INVENTION

This need is met by the present invention, in which an extrusion unit is integrated with a foaming unit and a liquid metal pumping unit, so that the extruded shell can be filled as it is formed with the metallic foam, thereby guaranteeing a good metallurgical bond between the shell and the core. In the present invention, the shell metal remains solid throughout the process, albeit at very high temperatures, often close to the metal solidus temperature, while the metallic foam remains in liquid state until such time that it fills the shell. The shell and core are cooled down to room temperature at such rate that the bond remains intact. Further, since the shell is filled as it is formed, the surface quality of the profile remains the same as a standard extruded profiles.

DETAILED DESCRIPTION OF THE INVENTION

The present invention includes making an extruded shell filled with a foam core via an apparatus to form a thin walled shell, an apparatus to form the foam core, preferably in liquid or semi liquid form, and an apparatus to pump the foam into the extruded shell. Integration of all the three apparatuses together provides a simple and economic way of making foam filled extrusions in a continuous mode with acceptable surface, dimensional, and mechanical properties.

FIG. 1 schematically shows a twin wheel conform extruder 2 for co-extruding a metal shell 4 around a foam 6 according to the present invention. Examples of twin wheel conform devices that may be adapted for use in the present invention are described in U.S. Pat. Nos. 4,217,852 and 5,000,025, both incorporated herein by reference. The conform extruder 2 of the present invention includes a pair of wheels 8 each defining a groove (not shown) for accepting feedstock 10, a wheel housing 12, and a tool block 14. Wheel housing 12 defines outlet cavities 16 for the feedstock 10, the cavities 16 communicating with a central bore 18 in the tool block 14. A hollow mandrel 20 is fitted within the central bore 18. The exterior surface 22 of the hollow mandrel 20 defines the internal diameter of a tubular extrusion or shell 4, while the internal surface 24 of the hollow mandrel 20 provides for flow of foam 6 therethrough. The feedstock 10 is extruded into a shell 4 in a conventional manner, such as described in the '025 patent for extruding with a hollow mandrel. The foam 6 that passes through the hollow mandrel 20 flows into the extruded shell 4 as the shell 4 is formed. Both the shell 4 and the foam 6 are at very high temperatures and readily bond metallurgically at or near the position at which the foam 6 contacts the shell 4 being extruded. Bonding is further facilitated by the nature of the extruded shell surface, particularly the interior surface. As the shell 4 exits the tool block 14, the interior surface is relatively clean from oxide skin and the like. The tool block 14 may be made of standard hot forming tool steel such as AISI H13 or H23 type steels. For extruded materials that require high operating temperatures, the tool block 14 may be made of super alloys or ceramic materials such as tungsten carbide.

The extruder 2 further includes a foaming unit 26 and a furnace 28 (e.g. a crucible furnace of small volume heated by coreless induction method or a larger unit split into multiple compartments and heated by oil or gas) into which the foaming unit is immersed to form the foam. A sleeve 30 extends from the foaming unit into the tool block 14. Since the foam 6, in particular aluminum foam, has a tendency to attack all metallic materials including steels, when present as liquid, the sleeve 30 may be non-metallic (standard graphite or heavy duty ceramic materials such as alumina, titanium boride or the like) and be surrounded by an outer sleeve 32 for strength outside of the tool block 14.

Foam may be produced by many methods such as by purging an inert gas such as nitrogen or argon into a liquid metal or by adding intentionally solids such as hydrides, hydroxides, carbonates, and nitrides which easily decompose at the operating temperatures, e.g. about 650° C., thus releasing the gases which are then held in the liquid metal by suitably choosing the alloy and process conditions. One suitable method of producing metal foam is described in a co-pending application Ser. No. 10/150,338 filed May 20, 2002 entitled "Method for Producing Foamed Aluminum Products", incorporated herein by reference. A well-known method uses aluminum alloys containing solid particles such as aluminum oxide and silicon carbide. When the gas is purged through the liquid metal containing these solid inclusions, a liquid foam or emulsion is produced and is stabilized by the interaction between the gas bubbles and the solid inclusions. The liquid foam may be drawn off or pumped into a container of suitable shape and form. Scrap aluminum, which contains all types of elements (such as iron, silicon, and copper, which are generally considered to be undesirable in aluminum alloys and are often removed in normal usage) may be used to minimize the cost of feed materials. The solid inclusions may be precipitated out of the liquid aluminum in situ by controlling the temperature. At normal operating temperatures of about 600 to about 650° C., an aluminum alloy containing 1–2 wt. % iron, 1–2 wt. % silicon and similar levels of copper, titanium, and the like provides sufficient amount of solid inclusions to stabilize the foam with foam cells sized about 0.5 mm to about 1 mm.

In traditional foam manufacturing processes, the natural physics of the foaming process itself can be used to pump the foam. During foaming, the volume of liquid foam increases considerably. The force of the expanding foam causes the foam to flow into the tool block 14. It may be necessary to use additional pumping techniques so as to provide the foam into the tool block at the same rate at which the shell is extruded. Several conventional pumping methods are available to transport liquid metals. For aluminum alloys and magnesium alloys, pneumatic pumps may be used. Electromagnetic pumping may be used to avoid pressurizing the metal foam. Electromagnetic pumping involves applying a transverse magnetic field to an electrically conducting fluid to create a mechanical force to move the liquid foam. No moving parts are used and electromagnetic pumping is simple easy to set up and operate. A device for creating the magnetic field formed from a ceramic or the like may be immersed in the liquid foam.

The conform extruder 2 may produce an extruded metallic shell 4 about 0.02 to about 0.5 inch thick. A suitable aluminum alloy is Aluminum Association (AA) alloy 6063, but this is not meant to be limiting. Other aluminum alloys or other metal alloys may be used in the present invention.

Metal feedstock 10, typically a coiled cast or extruded rod or powdered metal, is fed into grooves (not shown) of conform wheels 8 and fluidizes the feedstock 10 reaches extrusion tool block 14. The feedstock 10 is fed normally at room temperature and if required may be heated before reaching the conform wheels 8 using a simple induction heating unit (not shown). The rods 10 may be cleaned prior to feeding by passing them through a cleaning unit, which may be of chemical nature like acid or alkaline process to improve adhesion between the extruded shell and the foam. The rods 10 normally are heated during their passage through the wheel housing due to the heat generated by deformation and may reach temperatures approaching the solidus temperature of the levels of the alloy (e.g. 600° C. for alloy AA 6063), and may not require a separate heating unit.

FIG. 1 illustrates extrusion of a cylindrical tube, but this is not meant to be limiting. Many other geometrical configurations for the tool block 14 and hollow mandrel 16 may be employed to produce more complex shapes. In use, the foam 6 reaching the terminal end of the hollow mandrel 20 fills the shell 4 is the shell 4 is being extruded in the die formed by the tool block 14. A metallurgical bond forms between the foam 6 and the shell 4. As the foam 6 and shell 4 cool, the bond strength increases. The composite product of shell 4 with foam core 6 may be cooled in a cooling unit 34 as needed.

Figure 2:
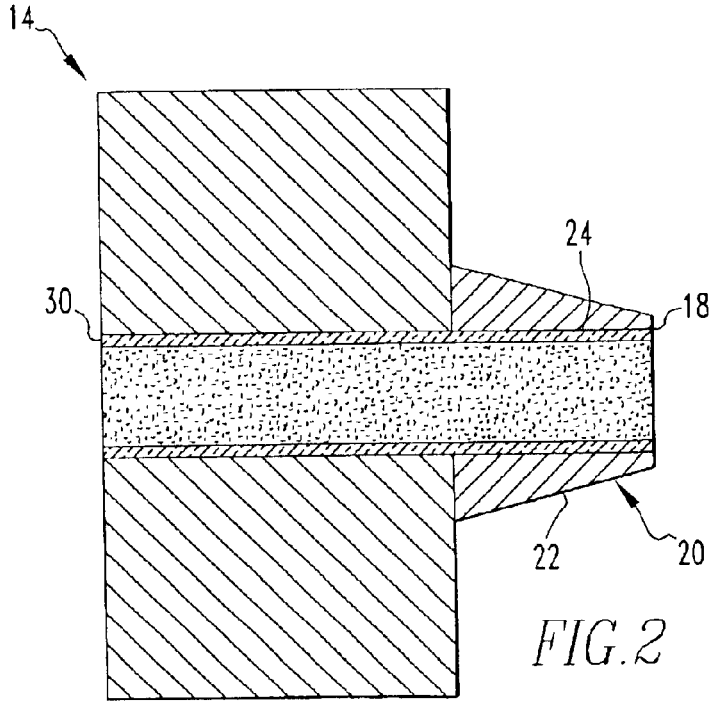
Figure 3:
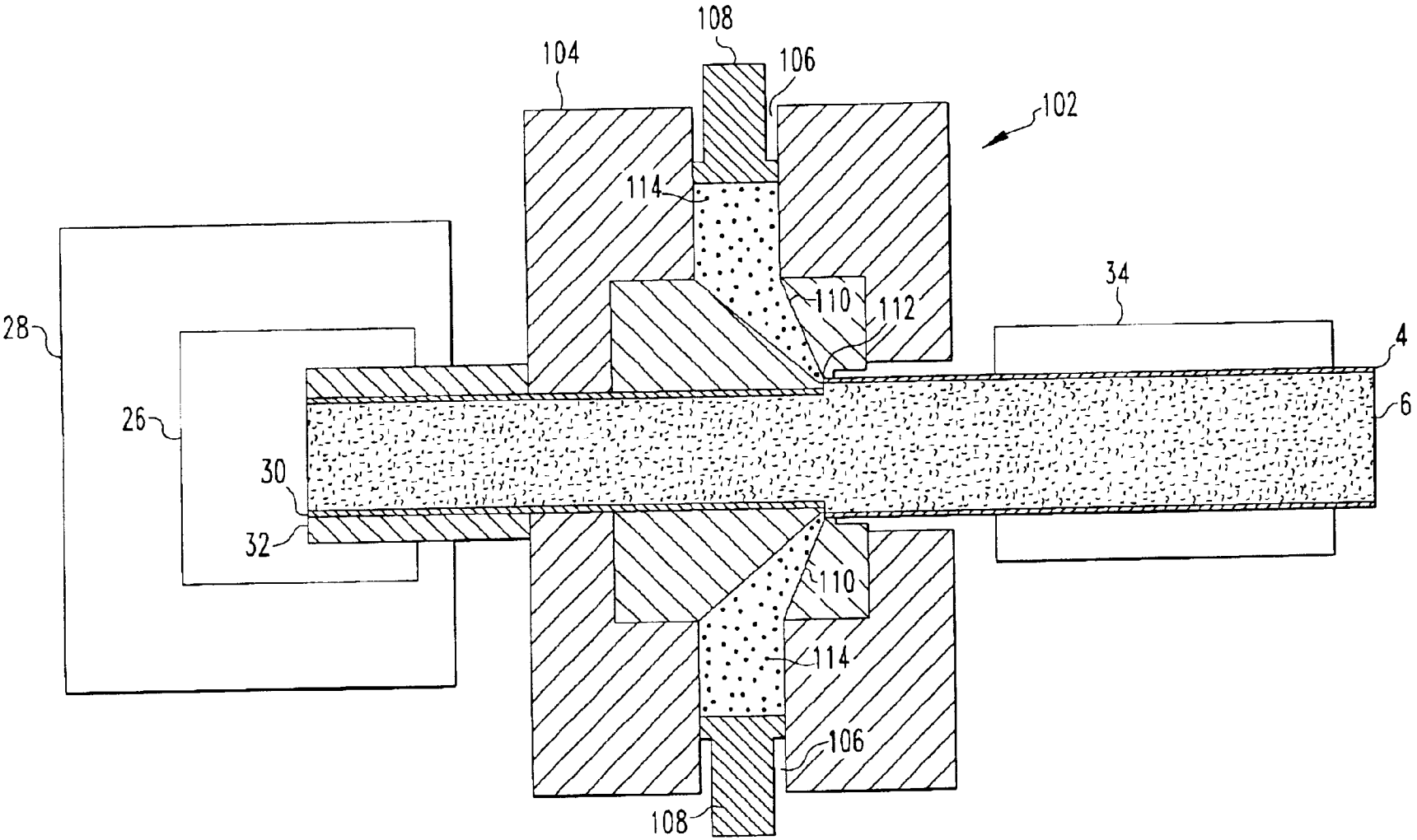

FIG. 2 illustrates another embodiment of the invention that includes a cladding extruder 102 for extruding shell 4 around foam 6. The cladding extruder 102 differs from the conform extruder 2 in the mechanism for extruding the shell 4 and is suited for extruding materials more difficult to extrude than alloy AA 6063. The cladding extruder 102 includes a housing 104 (which may be composed of multiple components for rapid disassembly and reassembly) defining a pair of chambers 106 in which pistons 108 are slidably received. The chambers 106 communicate through a narrowed portion 110 with a die 112 which is shown as annular in FIG. 3, other configurations being acceptable.

In use, billets of extrudable metal 114 (which may be preheated) are placed within the chambers 106 and pistons 108 urge the metal 114 through the die 112 to extrude a circular tube 4. Foam 6 is delivered to the die 112 in a manner similar to the foam delivery described above for the conform extruder 2. The cladding extruder 102 may be used with high strength materials and operated as a traditional extrusion press. The extrusion speed may be controlled as is required depending upon the foam flow rate.

The present invention provides for production of extruded shells filled with cellular materials such as metallic foam, economically with the required product characteristics like surface quality, dimensional stability, and other mechanical and physical characteristics. This process may be used for many metallic materials, including low temperature structural materials such as aluminum alloys and magnesium alloys. A good metallurgical bonding is formed between the extruded product and foam that enhances performance characteristics such as load transfer characteristics between the shell and the foam and energy absorption characteristics.

We claim:

1. In a method of operating a metal extrusion device for extruding a feedstock and having peripheral components for receiving feedstock, an extrusion die defining a cavity for receiving feedstock from the peripheral components, an extrusion mandrel mounted in the die and surrounded by the cavity, the extrusion mandrel having a terminal end and defining an axial bore, the improvement comprising:

extruding a first metal through the cavity and past the terminal end of the mandrel; and simultaneously delivering liquid foam of a second metal through the axial bore such that the foam exiting the terminal end of the axial bore is metallurgically bonded to the metal extruded through the cavity thereby producing a composite of an extruded metal shell bonded to a metal foam core.

2. The method of claim 1 wherein the first metal and the second metal are aluminum alloys.

3. The method of claim 2 wherein the first metal and the second metal are at a temperature of about 600 to about 650° C.

4. The method of claim 2 wherein the first metal is alloy AA 6063.

5. The method of claim 1 wherein the extruded metal shell is 0.02 to about 0.5 inch thick.

6. The method of claim 1 wherein the first metal is in the form of an aluminum rod or an aluminum billet.

7. The method of claim 1 further comprising pumping the liquid metal foam into the axial bore.

8. The method of claim 1 wherein the peripheral components comprises a pair of feed wheels having peripheral feed grooves for receiving the feedstock and mounted for rotation about axes relative to the die to urge the feedstock into the cavity.

9. The method of claim 1 wherein the peripheral components comprises a pair of feed chambers for receiving the feedstock and pistons for urging the feedstock from the chambers into the cavity.

10. An apparatus for producing a composite of an extruded metal shell bonded to a metal foam core comprising:

a metal extrusion device for extruding a feedstock and having peripheral components for receiving metal feedstock, said peripheral components comprising a pair of feed chambers for receiving said feedstock and pistons for urging said feedstock from said chambers into the cavity of an extrusion die, an extrusion mandrel mounted in said die and surrounded by said cavity, said extrusion mandrel having a terminal cud and defining an axial bore;

a metal foam delivery member for supplying liquid metal foam through said axial bore, whereby providing metal feedstock to said peripheral components and extruding the metal through the cavity while providing metal foam through said axial bore causes the foam exiting the axial bore to metallurgically bind to the extruded metal to form a foam core covered by an extruded metal shell.

11. The apparatus of claim 10 wherein member further comprises a foam production member for producing liquid metal foam for delivery to said axial bore.

12. The apparatus of claim 10 wherein said foam delivery member further comprises a pump for delivering liquid metal foam to said axial bore.

13. The apparatus of claim 10 further comprising a sleeve extending from said foam delivery member to said axial bore terminal end and lining said axial bore to maintain the liquid foam spaced apart from the metal extrusion device.

14. The apparatus of claim 10 wherein the peripheral components comprises a pair of feed wheels having peripheral feed grooves for receiving the feedstock and mounted for rotation about axes relative to die die to urge the feedstock into the cavity.

* * * * *